US008327473B2

(12) United States Patent
Matsubara et al.

(10) Patent No.: US 8,327,473 B2
(45) Date of Patent: Dec. 11, 2012

(54) SAUNA DEVICE

(75) Inventors: Mitsunori Matsubara, Kanagawa (JP); Yoshimasa Katsumi, Aichi (JP); Yoshihiro Nishizuru, Aichi (JP); Satoshi Fujii, Aichi (JP); Bungo Takeuchi, Aichi (JP)

(73) Assignee: Panasonic Corporation, Osaka (JP)

( * ) Notice: Subject to any disclaimer, the term of this patent is extended or adjusted under 35 U.S.C. 154(b) by 1131 days.

(21) Appl. No.: 11/910,711

(22) PCT Filed: Sep. 30, 2005

(86) PCT No.: PCT/JP2005/018580

§ 371 (c)(1),
(2), (4) Date: Oct. 4, 2007

(87) PCT Pub. No.: WO2006/109364

PCT Pub. Date: Oct. 19, 2006

(65) Prior Publication Data

US 2009/0056009 A1 Mar. 5, 2009

(30) Foreign Application Priority Data

Apr. 11, 2005 (JP) ..... 2005-113237

(51) Int. Cl.
*A61H 33/06* (2006.01)

(52) U.S. Cl. ..... 4/524; 4/525; 261/130

(58) Field of Classification Search ..... 4/524, 525; 607/81–87; 261/130
See application file for complete search history.

(56) References Cited

U.S. PATENT DOCUMENTS

| | | | | |
|---|---|---|---|---|
| 4,055,863 | A * | 11/1977 | Duval | 4/601 |
| 4,287,618 | A * | 9/1981 | Silver | 4/443 |
| 4,300,556 | A * | 11/1981 | Ochi et al. | 604/291 |
| 4,833,739 | A * | 5/1989 | Sakakibara et al. | 4/524 |
| 6,623,511 | B1 * | 9/2003 | Daffer et al. | 607/82 |
| 6,681,417 | B2 * | 1/2004 | Brunelle et al. | 4/597 |
| 7,055,763 | B2 | 6/2006 | Torigoe | |

FOREIGN PATENT DOCUMENTS

| | | |
|---|---|---|
| EP | 1 219 281 | 7/2002 |
| JP | 63-13142 | 1/1988 |

(Continued)

OTHER PUBLICATIONS

International Search Report issued Jan. 10, 2006 in the International (PCT) Application of which the present application is the U.S. National Stage.

*Primary Examiner* — Dinh Q Nguyen
(74) *Attorney, Agent, or Firm* — Wenderoth, Lind & Ponack, L.L.P.

(57) ABSTRACT

A sauna cabinet is humidified and heated without airborne perceivable water drops by the use of a fine spray. The user can thus remain comfortably in the sauna cabinet that is free of airborne perceivable water drops. The user's view is also not clouded by mist. Accordingly, the user can enjoy viewing images and reading books in the sauna cabinet, and a user's sensible temperature distribution in the sauna cabinet is also uniform. This sauna equipment thus provides uniform temperature and humidity even in a large bathroom. The sauna equipment includes a first circulator and a second circulator for circulating air in the sauna cabinet, an air heater for heating supplied air, and a water atomizer for turning supplied water into fine water drops.

17 Claims, 7 Drawing Sheets

FOREIGN PATENT DOCUMENTS

| | | |
|---|---|---|
| JP | 3-49468 | 7/1991 |
| JP | 6-088629 | 3/1994 |
| JP | 06-327741 | 11/1994 |
| JP | 09-028755 | 2/1997 |
| JP | 10-155866 | 6/1998 |
| JP | 2000-325424 | 11/2000 |
| JP | 2000-329382 | 11/2000 |
| JP | 2001-095890 | 4/2001 |
| JP | 2001-187103 | 7/2001 |
| JP | 2001-231837 | 8/2001 |
| JP | 2001-293294 | 10/2001 |
| JP | 2002-303438 | 10/2002 |
| JP | 2002-336327 | 11/2002 |
| JP | 2003-024733 | 1/2003 |
| JP | 2003-299710 | 10/2003 |
| JP | 2003-325635 | 11/2003 |
| JP | 2003-334230 | 11/2003 |
| JP | 2003-339817 | 12/2003 |
| JP | 2004-290476 | 10/2004 |
| JP | 2005-021429 | 1/2005 |
| JP | 2005-087327 | 4/2005 |
| JP | 2005-087328 | 4/2005 |
| WO | 03/073976 | 9/2003 |

* cited by examiner

FIG. 10 – PRIOR ART
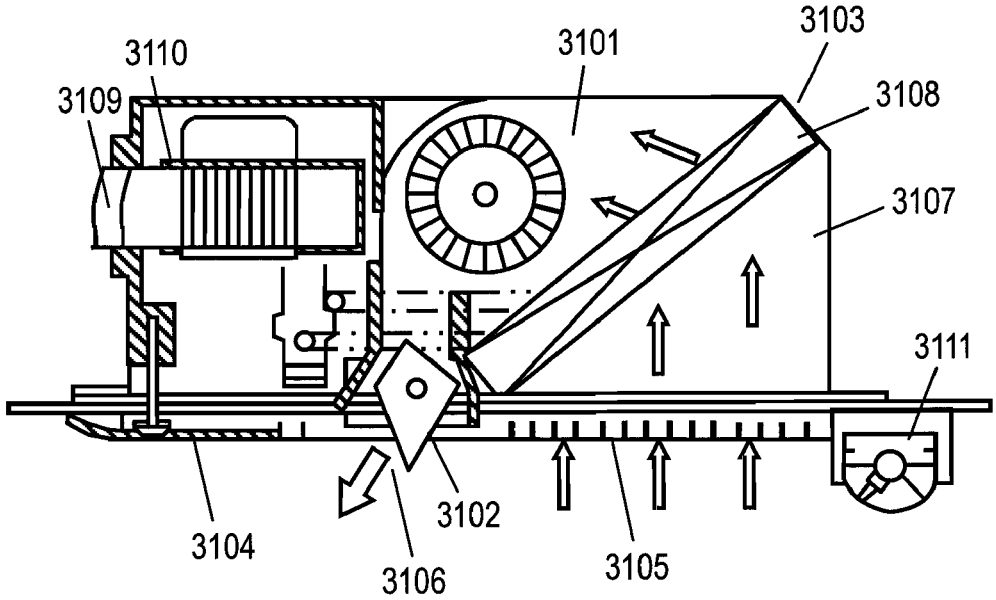
FIG. 11 – PRIOR ART
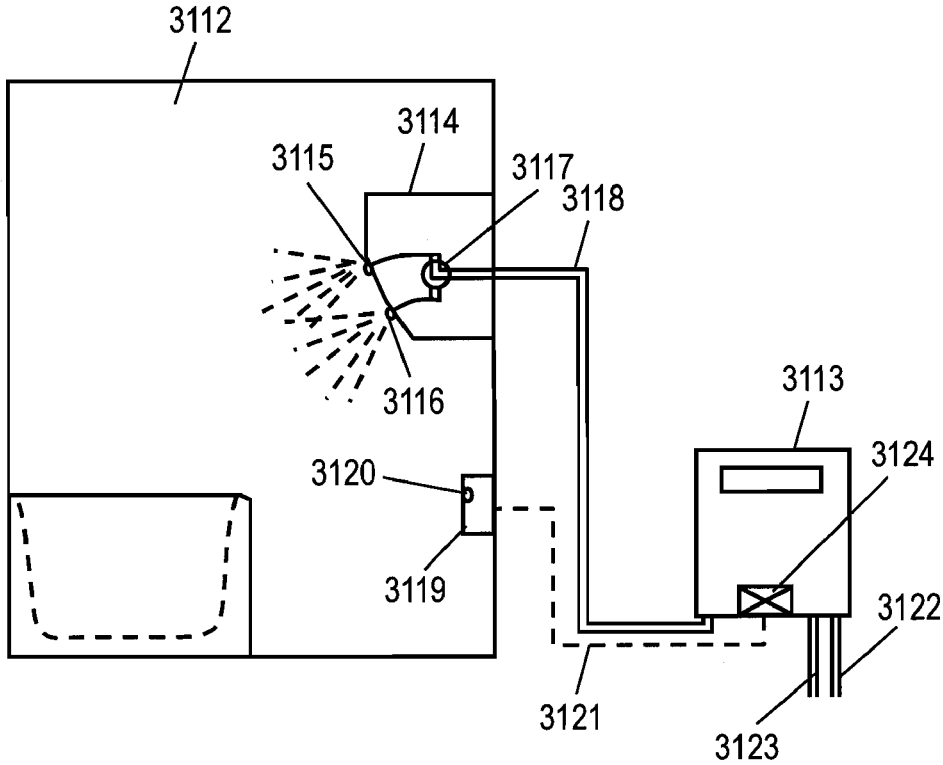

SAUNA DEVICE

This application is a U.S. national phase application of PCT International Application PCT/JP2005/018580, filed Sep. 30, 2005.

FIELD OF THE INVENTION

The present invention relates to sauna equipment that offers a sauna space by humidifying a sauna cabinet.

BACKGROUND OF THE INVENTION

One type of conventional sauna equipment humidifies a sauna cabinet by supplying hot water to a mist sprayer. (For example, refer to pp 3 to 7 and FIGS. 1 to 5 of Japanese Patent Unexamined Publication No. 2002-336327.)

The conventional sauna equipment is described below with reference to FIG. 8.

As shown in FIG. 8, main unit 1101 of the sauna equipment includes air-circulating channel 1105 for taking air into sauna cabinet 1103 via air inlet 1102 and blowing air to inside sauna cabinet 1103 via air outlet 1104, circulating fan 1106 for feeding air to this air-circulating channel 1105, heat exchanger 1108 as air heater 1107 for heating air passing through air-circulating channel 1105, thermomotive valve 1109 for intermittently supplying hot water to this heat exchanger 1108, spraying nozzle 1111 as mist sprayer 1110, hot-water channel 1112 for supplying hot water to spraying nozzle 1111, and solenoid valve 1113 for intermittently supplying hot water to spraying nozzle 1111. Hot water supplied through hot-water channel 1112 is sprayed from spraying nozzle 1111 in the form of a mist. Circulating fan 1106 is activated, and hot water, which is a heat-carrying medium, is also circulated and supplied to heat exchanger 1108 by controlling the opening and closing of thermomotive valve 1109 so as to maintain the temperature inside sauna cabinet 1103 at a predetermined temperature. A high-temperature and high-humidity sauna space is achieved by blowing circulating air heated by this heat exchanger 1108 to inside sauna cabinet 1103.

Types of sauna include a dry sauna which produces a high-temperature low-humidity environment of about 100° C. and relative humidity of 10% in the cabinet, and a steam sauna which produces a medium-to-high temperature and high-humidity environment of about 40 to 50° C. and relative humidity of 70% or higher. Sauna equipment has recently been drawing attention which can be installed in a bath or shower room to permit the use of the bath or shower room itself as a sauna cabinet. Various types of steam saunas have been proposed. (For example, refer to p 5 and FIG. 3 in Japanese Patent Unexamined Publication No. H6-63103.)

FIG. 9 is a sectional view of the key parts of conventional sauna equipment, briefly illustrating its internal structure. As shown in FIG. 9, hot-water spraying pipe 2105 with multiple hot-water spraying nozzles 2104 is disposed on the upper part of the inside of external housing 2101. Heat-exchange accelerator 2108, configured with multiple thin plates 2107 and coupling pipes 2106, is disposed underneath hot-water spraying pipe 2105. Fan unit 2109 is disposed underneath heat-exchange accelerator 2108. A proportion of the hot water sprayed from hot-water spraying nozzles 2104 to heat-exchange accelerator 2108 evaporates and generates steam. This steam is added to the air taken in by fan unit 2109 from air inlet 2102 and is then blown into the sauna cabinet from steam outlet 2103. The hot water after heat exchange is collected in drain pan 2110 and discharged outside.

One known example of this type of conventional sauna equipment is mist equipment which is installable on a ceiling of a bathroom to permit the use of the bathroom as a sauna cabinet. (For example, refer to pp 3 to 5 and FIG. 5, Japanese Patent Unexamined Publication No. 2002-336327.)

This mist equipment is described next with reference to FIG. 10.

As shown in FIG. 10, grille plate 3104 is disposed to cover main unit 3103 in which circulating fan 3101 and movable louver are provided. Main unit 3103 includes air-circulating channel 3107 for taking in air inside the cabinet via air inlet 3105 and blowing it from air outlet 3106, circulating fan 3101 for feeding air to air-circulating channel 3107, heat exchanger 3108 for heating air passing through air-circulating channel 3107, and movable louver 3102 for changing the direction of the air blown through air outlet 3106. Furthermore, ventilation fan 3110 is provided so as to take in air inside the cabinet and discharge it outside through exhaust duct 3109, and mist sprayer 3111 for spraying mist inside the cabinet is provided at the side of air inlet 3105. This creates a sauna space.

Another known example of sauna equipment is a mist-type bathroom heater in which a mist nozzle unit is installed in a bathroom. (For example, refer to p 2 and FIG. 1 of Japanese Patent Unexamined Publication No. H6-88629.)

This mist-type bathroom heater is described next with reference to FIG. 11.

As shown in FIG. 11, mist nozzle unit 3114 connected to bathwater boiler with mist sauna function 3113 is installed in bathroom 3112. This mist nozzle unit 3114 is equipped with large mist nozzle 3115 for discharging a large volume of mist and small mist nozzle 3116 for discharging a small volume of mist. Switching valve 3117 switches hot water supplied through pipe 3118 between large mist nozzle 3115 and small mist nozzle 3116. Mist remote control 3119 and temperature sensor 3120 are provided in bathroom 3112, and these are connected to bathwater boiler with mist sauna function 3113 by signal line 3121. Gas supply line 3122 and water-supply line 3123 are also connected to bathwater boiler with mist sauna function 3113.

In this equipment, controller 3124 switches switching valve 3117 to large mist nozzle 3115 when the temperature inside bathroom 3112 is low, so as to emit a large amount of mist to bathroom 3112, and then switches to small mist nozzle 3116 when the temperature inside bathroom 3112 reaches a predetermined temperature.

SUMMARY OF THE INVENTION

Sauna equipment includes a heater for heating air; a heated air feeder for feeding air heated by the heater; a direct sprayer for emitting water or hot water; a water feeder for supplying water or hot water to the direct sprayer; and an air inlet and air outlet for feeding air. The direct sprayer is disposed downstream of the heated air feeder.

BRIEF DESCRIPTION OF DRAWINGS

FIG. 10 is a sectional view of a state that mist and heated air are blown from conventional mist equipment.

FIG. 11 is a schematic view of a state that mist is blown from a conventional mist-type bathroom heater.

DETAILED DESCRIPTION OF PREFERRED EMBODIMENTS

Figure 1:
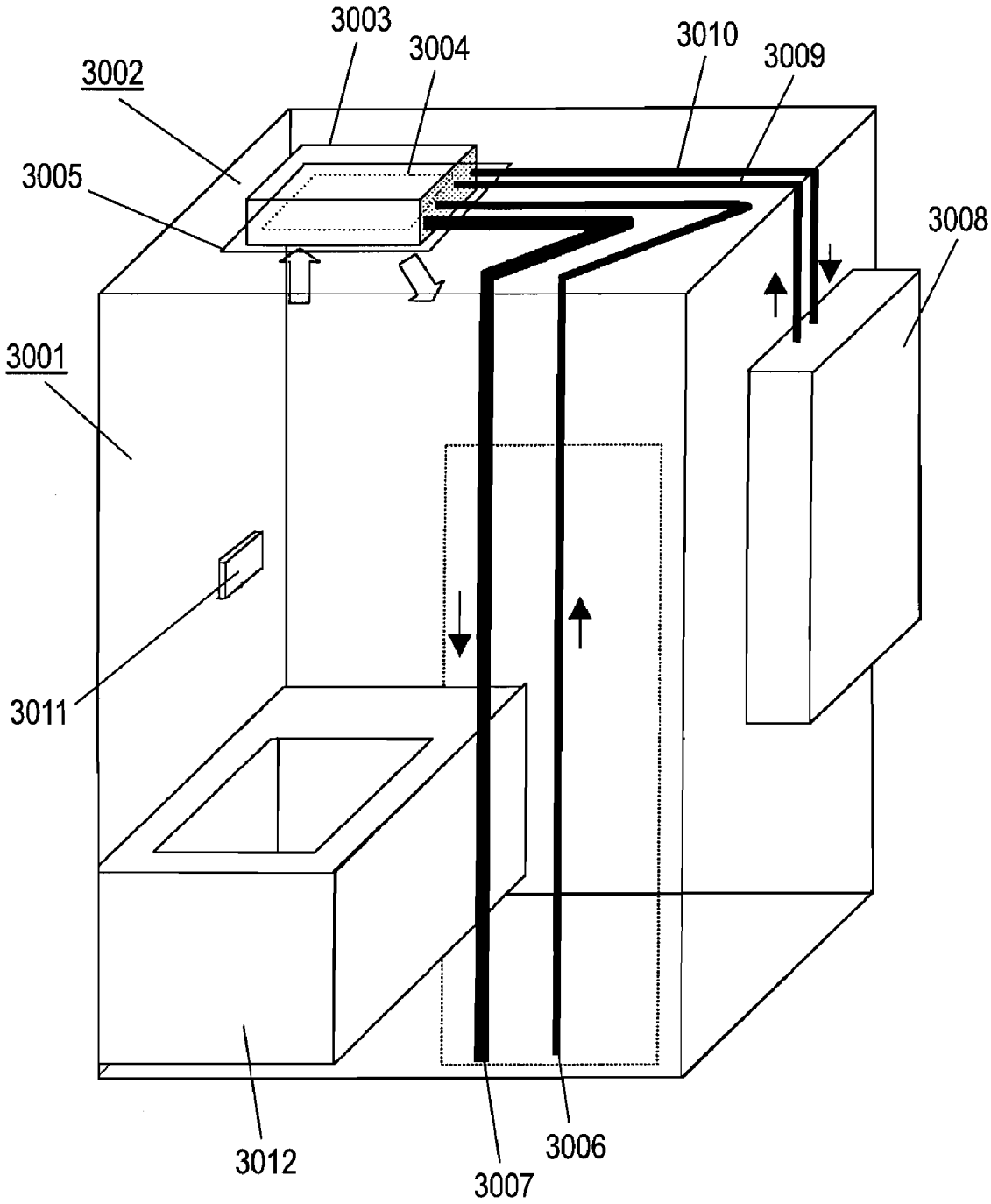
FIG. 1 illustrates an installation state of sauna equipment in accordance with a first exemplary embodiment of the present invention.

In the aforementioned conventional sauna equipment, the nozzle emits water drops with a diameter of 1 to 500 μm in the form of a mist. In this case, the mist can only reach a limited area, and large water drops drip down. Accordingly, temperature and humidity become different with an area where the mist does not reach in a large bathroom. In addition, if the heated air is emitted from the air outlet of the sauna equipment and the mist is emitted from the spraying nozzle separately, difference in the temperature and humidity also occur because the heated air and mist do not mix thoroughly. Uniform temperature and humidity by mixing hot air and humidity, even in a large bathroom, have been demanded.

Still more, since the air inlet for the mist spraying nozzle is provided on the side of the air inlet, a portion of sprayed mist is taken in to the air inlet, causing attachment of a large amount of water drops to the air inlet or dew condensation. To suppress propagation of molds, it is necessary to reduce dew condensation.

Still more, since the mist spraying nozzle is provided on the side of the air inlet, there are many design restrictions. Diverse designs that meet user's preference have been demanded.

Still more, if large water drops directly drip on the user's body when cold water is emitted at starting spraying, the user feels less comfort. Water drops also draw vaporization heat from the body surface and water drops and sweat are also difficult to distinguish, reducing perception of taking sauna. Such perception is different among individuals. Water drops also drip on a book if the user prefer reading. The user demands a comfortable space that no water drops drip while taking a sauna, more like a dry sauna but less physical burden, and no limitation in activities like reading, similar to the dry sauna.

Still more, the conventional sauna equipment emit heated air and mist separately to the cabinet. This makes the control of temperature and humidity difficult. If the amount of water emitted from the nozzle cannot be linearly adjusted, the heating output and humidification output are difficult to be controlled just by switching the nozzles. Accordingly, a quick startup and easy temperature and humidity control have been demanded.

The present invention solves these disadvantages of the prior art. An object of the present invention is to offer highly reliable sauna equipment with good controllability that can achieve uniform temperature and humidity distribution even in a large bathroom, reduce dew condensation in the main unit and on walls of the bathroom, provide diverse designs satisfying users' preferences, offer an environment similar to dry sauna while reducing physical burden regardless of a difference in perception among individuals, allow reading in the sauna cabinet, improve comfort by a quick startup, and facilitate the control of temperature and humidity.

To achieve the object, the sauna equipment of the present invention includes a heater for heating air, a heated air feeder for feeding air heated by this heater, a sprayer for emitting water or hot water, a water-supplier for supplying water or hot water to the sprayer, and an air inlet and outlet for air feeding. The sprayer is provided downstream of the heated air feeder.

This enables emission of relatively large water drops together with heated air, and thus water drops are turned into fine water drops, achieving a sauna space with uniform temperature and humidity even in a large bathroom. Uniform temperature and humidity facilitates the control of temperature and humidity, achieving the sauna equipment that offers a space with stable temperature and humidity. In addition, relatively large water drops are atomized, and thus the sauna equipment that can reduce attachment of water drops and dew condensation is achievable.

Another means of the present invention is to provide the direct sprayer near an upstream of the air outlet, and an adjustable louver on the air outlet to change an air-feeding direction.

This enables a change in a mist-spraying angle by the angle of air-feeding direction. Accordingly, a highly-reliable mist sprayer can be achieved without the need of providing a separate driver for changing the mist spraying angle. In addition, since the sprayer is provided inside the adjustable louver, this sauna equipment offers diverse designs, satisfying users' preferences.

Another means of the present invention includes a humidifier for humidifying air, and a humidified air feeder for feeding the air humidified by this humidifier. A condition of the air emitted can be changed by controlling the operation of the heater, heated air feeder, water-supplier, louver, humidifier, and humidified air feeder. Accordingly, the sauna environment, i.e., a proportion of the size of water drops in the air, can be changed.

In this means, if only the water-supplier is operated, a conventional sauna environment using nozzle spraying is produced. If the heated air feeder is operated in addition to the water-supplier, a sauna environment with reduced amount of large water drops is produced. If the humidifier and humidified air feeder are operated, an environment of only fine water drops, similar to a dry sauna, is achieved. An environment similar to dry sauna while reducing physical burden, regardless of differences in perception among individuals, allows reading in the sauna cabinet. In addition, the sauna equipment with good controllability that improves comfort is achieved by faster startup and easy control of temperature and humidity.

Another means of the present invention configures the humidifier with the water-supplier for supplying water or hot water, a preliminary sprayer for emitting water or hot water supplied from the water-supplier, a water atomizer for atomizing water or hot water emitted from the preliminary sprayer by collision, and a vapor-liquid separator for separating water drops supplied from the water atomizer to large water drops and fine water drops and removing large water drops.

This facilitates humidification, and offers a space containing water molecule negative ions. Accordingly, the sauna equipment with good controllability and better comfort is achievable.

Another means of the present invention provides a heated-air feeding regulator in the heated air feeder, so as to adjust the heated air volume, and a humidified-air feeding regulator in the humidified air feeder, so as to adjust the humidified air volume.

This enables minute temperature and humidity control, and improves controllability, offering the sauna equipment with better comfort.

Another means of the present invention forms an outlet passageway by creating an opening for air outlet on a panel down the ceiling.

This reduces air resistance at the inlet passageway, achieving efficient fan operation. In addition, flexibility in a layout of the heated air feeder and humidified air feeder in the equipment increases, offering highly-reliable sauna equipment.

Another means of the present invention provides a main valve on the water-supplier for supplying water or hot water, a preliminary sprayer spraying water or hot water supplied from the water-supplier, and a direct spraying valve and a preliminary spraying valve as an on-off valve on the direct sprayer and preliminary sprayer, respectively. Water remaining in the equipment at stopping the operation can thus be discharged by opening each on-off valve.

Since remaining water is discharged at stopping operation, the remaining water does not freeze inside the equipment, improving the reliability. In addition, a smell of remaining water and generation of mold can be suppressed, offering the sauna equipment with better comfort.

Another means provides the main valve on the water-supplier for supplying water or hot water, a preliminary sprayer spraying water or hot water supplied from the water-supplier, and also branches after the main valve. A direct sprayer or preliminary sprayer is provided on one of branches, and remaining sprayer of either direct sprayer or preliminary sprayer is provided in the other branch via the on-off valve.

This eliminates remaining water at stopping operation, and thus the remaining water does not freeze inside the equipment, improving the reliability. In addition, a smell of remaining water and generation of mold are suppressed. Still more, the remaining water is not emitted cold from the direct sprayer in the next spraying, achieving the sauna equipment with better comfort.

Another means of the present invention provides the on-off valve at the top part of the pipe.

This enables water discharged by closing the main valve regardless of an open angle of the on-off valve. Accordingly, water does not remain at stopping operation, and thus the remaining water does not freeze inside the equipment, improving the reliability. In addition, a smell of remaining water and generation of mold are suppressed. The remaining water is not emitted cold from the direct sprayer in the next spraying, easily achieving the sauna equipment with better comfort.

Another means of the present invention provides a preliminary sprayer spraying water or hot water supplied from the water-supplier and an opening in the direct sprayer at a position higher than an opening in the preliminary sprayer.

This prevents dripping of water from the air outlet at stopping operation, offering the sauna equipment with better comfort.

Another means of the present invention provides a preliminary sprayer spraying water or hot water supplied from the water-supplier and a water-supply temperature detector. When the water temperature is low, water is sprayed only from the preliminary sprayer.

This eliminates emission of the remaining water cold, and also ensures emission of water from the direct sprayer only after the water temperature increases, offering the sauna equipment with better comfort.

The present invention offers the sauna equipment that achieves uniform temperature and humidity anywhere in the bathroom.

Easy control of temperature and humidity offers the sauna equipment that provides a stable temperature and humidity space, contributing to improvement of user's comfort.

The present invention also offers the sauna equipment that reduces dew condensation typically at the air inlet, and suppresses generation of mold.

Since a driver for changing the spraying angle is not required separately, other than that for the adjustable louver, the present invention can offer further reliable sauna equipment.

In the present invention, the sprayer is provided inside the adjustable louver. Accordingly, the present invention can offer the sauna equipment with diverse designs satisfying users' preferences.

The temperature and humidity are controlled by switching the heated air feeder, sprayer, and humidified air feeder. Accordingly, the sauna equipment with quick startup that facilitates temperature and humidity control and satisfies diversifying users' preferences is achieved.

Still more, an environment similar to a dry sauna is achieved while reducing the physical burden, regardless of differences in perception among individuals. In addition, the sauna equipment offers a comfortable sauna cabinet that allows reading books inside.

Since the temperature and humidity are easily controllable, the present invention offers the sauna equipment that can produce various environments from high-temperature and high-humidity to a low-temperature and low-humidity.

Still more, the humidifying output is stably supplied with a compact humidifier. The sauna equipment can thus be installed in a narrow place such as a hidden area.

Still more, vapor and liquid are easily separated. Accordingly, only water drops with uniform size are blown from the air outlet, and relatively large water drops are not emitted from the air outlet. Accordingly, the present invention offers sauna equipment that enables the user to always take a comfortable sauna.

Still more, accumulated water is easily discharged without spraying remaining water. This prevents propagation of molds, and freezing of remaining water.

The present invention also offers the sauna equipment that can efficiently operate each fan.

The sauna equipment of the present invention includes the heater for heating air, heated air feeder for feeding the air heated by this heater, direct sprayer for emitting water or hot water, water-supplier for supplying water or hot water to the direct sprayer, and the air inlet and air outlet for feeding air. The sprayer is provided downstream of the heated air feeder, and mist generated by emitting water or hot water in a heated-air feeding area is blown together with the heated air, including relatively large particles, and the mist is carried and dispersed by airflow. At the same time, water drops turn into a fine spray by evaporation. Since the airflow circulate in the bathroom, the temperature and humidity can be made uniform. In addition, the temperature and humidity can be easily controlled by the volume of emitted heated air. Accordingly, a space with stable temperature and humidity can be produced. In addition, reduction of attachment of water drops to the air inlet and dew condensation suppresses propagation of molds.

Still more, the sprayer is provided near the upstream of the air outlet in the sauna equipment of the present invention. The louver which can change the air-feeding direction is provided on the air outlet. This eliminates the need of a separate driver for changing the spraying angle, except for the adjustable louver. The reliability is thus improved while achieving a space with uniform temperature and humidity. In addition, since the sprayer is provided inside the adjustable louver, diversifying designs that satisfy users' preferences can be achieved.

The sauna equipment of the present invention includes the humidifier for humidifying air and the humidified air feeder for feeding the air humidified by the humidifier. Operations of the heater, heated air feeder, water-supplier, louver, humidifier, and humidified air feeder are controlled so as to change the mist sauna environment, i.e., a proportion of large water drops, by changing the condition of emitted air. If only the water-supplier is operated, a large amount of relatively large water drops are contained only using the nozzle spray. Next, if the heated air feeder is operated in addition to the water-supplier, large water drops are evaporated by the heated air and turn into fine water drops, reducing the amount of large water drops. If the humidifier and humidified air feeder are operated, only fine water drops without large water drops are contained. These states are controllable as required. Accordingly the present invention can change the mist sauna environment, i.e., a proportion of large water drops.

Still more, in the sauna equipment of the present invention, the humidifier is configured with the water-supplier for supplying water or hot water, the preliminary sprayer for emitting water or hot water supplied from the water-supplier, the water atomizer for atomizing water or hot water emitted from the preliminary sprayer by collision, and the vapor-liquid separator for separating water drops supplied from the water atomizer to large water drops and fine water drops and removing the large water drops. Since large water drops are removed, only fine water drops are generated to supply the air of approximately 100% relative humidity. In a process of water atomization, water drops generated by spraying and further atomized by collision contribute to humidification. In addition, highly-humid air containing water molecule negative ions is generated by the Lenard's effect.

Still more, in the sauna equipment of the present invention, the heated-air feeding regulator is provided on the heated air feeder for changing the feeding volume of heated air, and the humidified-air feeding regulator is provided on the humidified air feeder for changing the feeding volume of humidified air. Heating of the sauna space is adjusted by the feeding volume of heated air, and the humidification and heating of the sauna space are adjusted by the feeding volume of humidified air. The temperature and humidity in the sauna space is minutely adjustable by adjusting these two feeding volumes, i.e., switchover of two fan notches.

Still more, in the sauna equipment of the present invention, an opening of the air outlet is created in the panel down the ceiling so as to form an outlet passageway, and the air inlet is created between the panel and ceiling and/or on the panel so as to form an inlet passageway. The entire opening on the bottom face thus becomes the inlet passageway. This reduces the air resistance in the inlet passageway, and enables efficient operation of the fan. In addition, a layout of the heated air feeder and humidified air feeder inside the equipment becomes more flexible. Accordingly, a simple structure is made feasible.

Still more, in the sauna equipment of the present invention, a main valve is provided on the water-supplier for supplying water or hot water, a preliminary sprayer spraying water or hot water supplied from the water-supplier is provided, and an on-off valve is provided on the direct sprayer and preliminary sprayer, respectively. When the operation stops, direct spraying valve and preliminary spraying valve are both opened to discharge remaining water. If the main valve provided on the water-supplier is closed, and the direct spraying valve and preliminary spraying valve are opened, air enters from one of the opening in the direct sprayer or preliminary sprayer. Accordingly, remaining water in the pipe can be discharged.

Still more, in the sauna equipment of the present invention, the main valve is provided on the water-supplier for supplying water or hot water, a preliminary sprayer spraying water or hot water supplied from the water-supplier is provided, and the water-supplier is branched after the main valve. The direct sprayer or preliminary sprayer is disposed on one of the branches, and remaining direct sprayer or preliminary sprayer is disposed on the other branch via a valve. If the preliminary sprayer is disposed on one branch, the preliminary sprayer emits mist for humidification as the humidifier when the main valve is opened. Then, when the direct spraying valve is opened, the direct sprayer emits mist for humidification. At stopping the operation, the main valve is closed and the direct spraying valve is opened so as to discharge the water remaining in the pipe.

Still more, in the sauna equipment of the present invention, the aforementioned on-off valve is provided on the top part of the pipe. Since the on-off valve exists at the top part, water is discharged when the main valve is closed, regardless of the opening degree of the on-off valve.

Still more, in the sauna equipment of the present invention, an opening in the direct sprayer is provided at a position higher than an opening in the preliminary sprayer. Since the remaining water is discharged from the opening in the preliminary sprayer, water does not drip to the air outlet.

Still more, in the sauna equipment of the present invention, the water-supply temperature detector is provided. When the water temperature is low, the water is emitted only from the preliminary sprayer, and the water is emitted from the direct sprayer only after the water temperature increases.

Next, the first to fifth exemplary embodiments of the present invention are described with reference to drawings.

First Exemplary Embodiment

FIG. 1 illustrates installation of sauna equipment in the first exemplary embodiment of the present invention.

In FIG. 1, main unit 3003 of the sauna equipment is disposed in space above the ceiling 3002 of sauna cabinet 3001, typically a bathroom. This main unit 3003 has a box shape with main unit opening 3004 which is an open bottom face. Main unit 3003 is connected to sauna cabinet 3001 via opening in ceiling 3005. Water-supply pipe 3006 is connected to this main unit 3003 as a water-supplier for feeding water or hot water to main unit 3003. Drain pipe 3007 for discharging water discharged from main unit 3003 is also connected. From boiler 3008, which is a heat source of a heater, hot-water approaching pipe 3009 and hot-water returning pipe 2010 are connected to main unit 3003 as a hot-water circulation line at the heat source side. Remote control 1011 for stopping the operation of the sauna equipment is installed in a dressing room or inside sauna cabinet 3001 such as bathroom. For example, remote control 1011 is installed near bathtub 3012.

Figure 2:
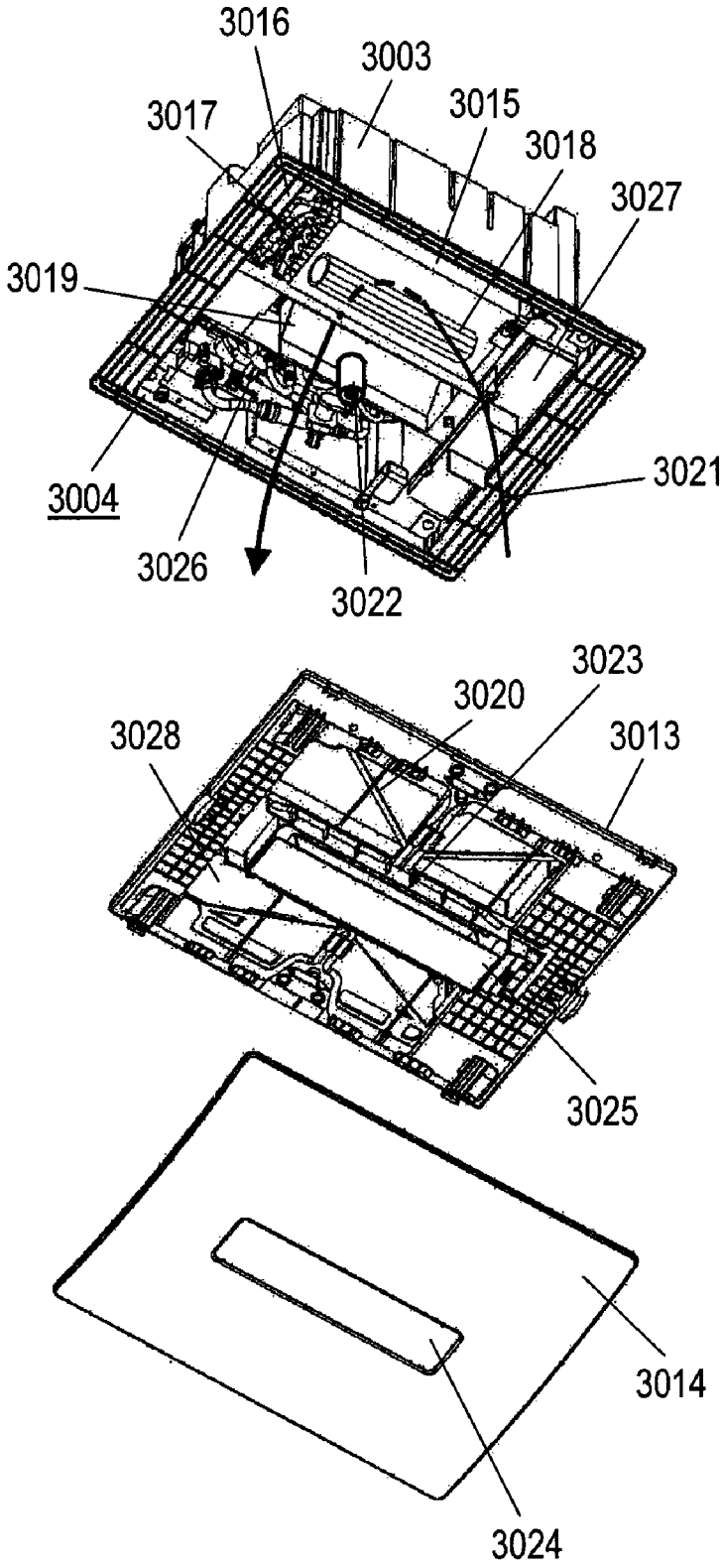
FIG. 2 is an exploded perspective view of the sauna equipment in accordance with the first exemplary embodiment of the present invention.

Next, FIG. 2 is an exploded perspective view of the sauna equipment in the seventh exemplary embodiment of the present invention including main unit 3003, inner panel 3013 covering main unit opening 3004, and outer panel 3014 attached to inner panel 3013 and exposed to sauna cabinet 3001 such as the bathroom. In FIG. 2, components same as FIG. 1 are given the same reference marks, and thus their description is omitted.

In FIG. 2, water-air heat exchanger 3015 of a fin-and-tube type is provided as a heater for heating air inside main unit 3003. Heat-exchanger inlet pipe 3016 of this water-air heat exchanger 3015 is connected to hot-water approaching pipe 3009 (not illustrated), and heat-exchanger outlet pipe 3017 is connected to hot-water returning pipe (not illustrated). Reflux fan 3018 is provided over water-air heat exchanger 3015 as a heated air feeder for feeding heated air. An air passageway (not illustrated) for reflux fan 3018 is formed inside main unit 3003, and an outlet of the air passageway is provided at a bottom part of main unit 3003 as main unit air outlet 3019. Main unit air inlet 3020 is provided on inner panel 3013, facing water-air heat exchanger 3015. When inner panel 3013 is attached and reflux fan 3018 is operated, heated air passageway 3021 is established from main unit air inlet 3020, passing through water-air heat exchanger 3015 and reflux fan 3018, and to main unit air outlet 3019 is formed.

To warm inside sauna cabinet 3001 and main unit 3003, i.e., heating, hot water from boiler 3008 is fed through hot-water approaching pipe 3009 to main unit 3003. After passing heat-exchanger inlet pipe 3016, heat exchange is performed in water-air heat exchanger 3015. Then, water returns from heat-exchanger outlet pipe 3017 through hot-water returning pipe 1010 to boiler 3008, which is the heat source. Air heated in this process is blown out from heated air passageway 3021.

In the down stream of the heated air feeder, direct spraying nozzle 3022 is connected to water-supply pipe 3006 (not illustrated) as a direct sprayer. This direct spraying nozzle 3022 is, for example, long in a longer direction of main unit air outlet 3019 and short in a shorter direction; and is a flat spraying type (Spraying angle in longer direction: 10° to 140°, Shorter direction: 20 mm width max at 100 mm from a spraying hole). Direct spraying nozzle 3022 emits mist such that it covers an air-feeding face of main unit air outlet 3019. However, as long as direct spraying nozzle 3022 is located downstream of the heated air feeder and mist is emitted to block most of the air passageway, positions other than near main unit air outlet 3019 are acceptable. When a city water is supplied to main unit 3003 via water-supply pipe 3006, inside sauna cabinet 3001 or main unit 3003 is humidified. The city water may also be supplied as hot water by passing through a boiler (not illustrated)

In the above structure, when the heater and the heated air feeder are operated, hot air at 50° C., for example, is supplied. When water or hot water is also emitted from direct spraying nozzle 3022 to this heated air passageway 3021, emitted water in the form of mist is carried in an airflow area of heated air. Accordingly, the mist is blown out from main unit air outlet 3019 into sauna cabinet 3001 while water drops are evaporated and become finer in a transfer process. Since a reflux airflow is generated in sauna cabinet 3001 so as to mix air, a sauna space with uniform temperature and humidity is produced. Water drops circulate in the cabinet as they reduce their sizes, and return through main unit air inlet 3020. Accordingly, attachment of water drops and dew condensation can be reduced, and thus wetness can be reduced.

Second Exemplary Embodiment

The second exemplary embodiment of the present invention has duct-like inner panel air outlet passageway 3023 connected to main unit opening 3005 and formed on inner panel 3013, as shown in FIG. 2. Air outlet 3024 is provided on outer panel 3014, facing inner panel air outlet passageway 3023. Louver 3025 which changes air feeding direction is provided on air outlet 3024.

Figure 3:
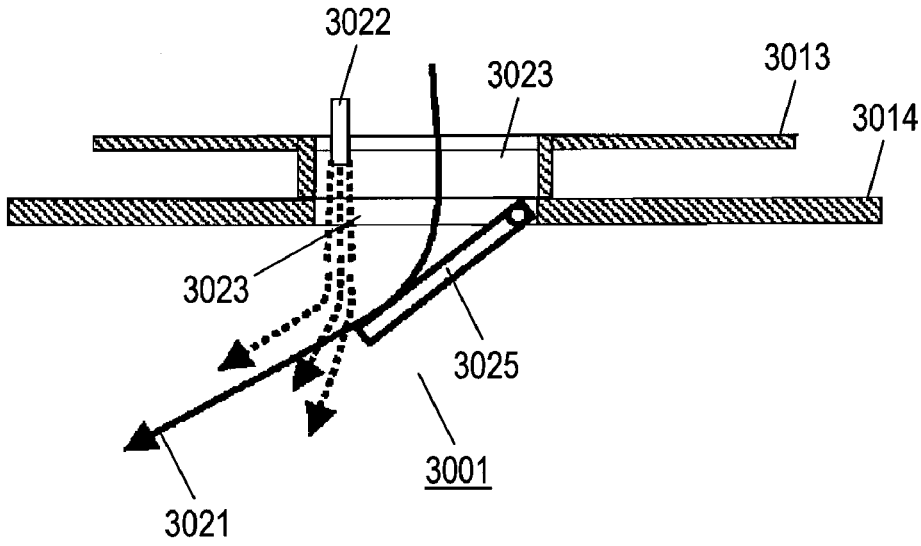
FIG. 3 is a sectional view of an air outlet of sauna equipment in accordance with a second exemplary embodiment of the present invention.

FIG. 3 is a sectional view of the air outlet of a sauna equipment in the eighth exemplary embodiment of the present invention, illustrating an internal structure of air outlet 3024. In FIG. 3, components same as FIGS. 1 and 2 are given the same reference marks, and thus their description is omitted.

In FIG. 3, direct spraying nozzle 3022 has a spraying position on inner panel air outlet passageway 3023 near an upstream side of air outlet 3024. The spraying direction from direct spraying nozzle 3022 is set toward inside the cabinet. A blowing direction of heated air passageway 3021 is adjustable by louver 3025.

In the above structure, mist emitted from direct spraying nozzle 3022 is carried in airflow when the louver direction is changed, and the mist is dispersed, changing a spraying angle in accordance with a changed blowing direction. Accordingly, no mechanical structure for driving direct spraying nozzle 3022 is required for changing the spraying direction. This achieves a highly reliable mist generator, and thus water drops do not travel directly to the user, realizing a comfortable mist generator. When the louver is directed downward, the wind direction is not changed, and water drops emitted are directly sprayed to sauna cabinet 3001. If air feeding through heated air passageway 3021 is stopped, it is apparent that a mist sauna same as the prior art is set up.

Since direct spraying nozzle 3022 is provided inside louver 3025, i.e., inside main unit 3003, direct spraying nozzle 3022 is not exposed outside the main unit. In addition, louver 3025 can also be closed at stopping the operation. Accordingly, the sauna equipment offering diversified designs that suit the user's preferences can be achieved by the design of outer panel 3014.

Third Exemplary Embodiment

In the third exemplary embodiment of the present invention, as shown in FIG. 2, main unit 3003 includes humidifying unit 3026 which has a humidifier for humidifying air and a humidified air feeder for feeding the air humidified by this humidifier, and electrical unit 3027 which houses electrical control devices as a controller of the sauna equipment. Humidifying air inlet 3028 is opened in inner panel 3013 at the bottom of humidifying unit 3026 so as to connect humidifying unit 3026 and sauna cabinet 3001.

Figure 4:
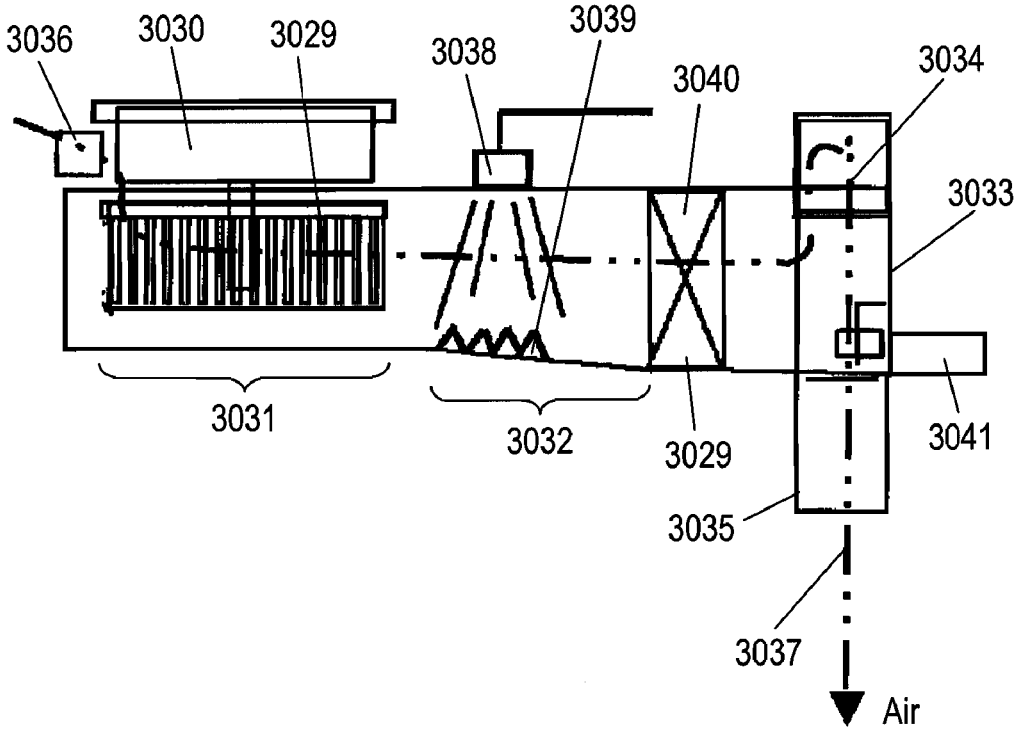
FIG. 4 is a sectional block diagram of a humidifying unit of sauna equipment in accordance with a third exemplary embodiment of the present invention.

FIG. 4 is a sectional view of an internal structure of humidifying unit 3026 of the sauna equipment in the third exemplary embodiment of the present invention. In FIG. 4, components same as those in FIGS. 1, 2, and 3 are given the same reference marks to omit duplicate description.

In FIG. 4, humidifying unit 3026 as a humidified air feeder for feeding humidified air is configured with, for example, sirocco fan 3029, humidified-air feeding motor 3030, and casing 3031 for guiding the airflow from sirocco fan 3029. Humidification duct 3032 is connected to casing 3031. End 3033 of humidification duct 3032 is covered, and opening 3034 is created on its top part to connect humidified air outlet duct 3035 to this opening 3034. Accordingly, humidified air inlet 3036 is provided at the inlet side of sirocco fan 3029 to form humidifying unit passageway 3037. One end of humidified air outlet duct 3035 joins heated air passageway 3021 (not illustrated) in inner panel outlet passageway 3023.

Preliminary spraying nozzle 3038 as a preliminary sprayer for emitting water or hot water is provided inside the duct at the top on humidification duct 3032. This preliminary spraying nozzle 3038 is connected to water-supply pipe 3006. Collision plate 3039 as a water atomizer for atomizing emitted water droplets is disposed at a position opposing preliminary spraying nozzle 3038 inside the duct. Collision plate 3039 is typically made of a net that has the effect of further dividing sprayed water droplets by collision. It is apparent that the atomization effect by collision increases if collision plate 3039 is made of a rigid material such as metal, or has a comb shape or unlevel surface. Eliminator 3040 as a vapor-liquid separator is provided downstream of humidifying unit passageway 3037. Drain outlet 3041 is provided at a bottom part of end 3033 of humidification duct 3032, and is connected to drain pipe 3007. Eliminator 3040 is made of resin which is inexpensive and easy to maintain. However, it is apparent that the vapor-liquid separation capability is improved if eliminator 3040 is a fin-and-tube type hot-water coil, metal eliminator, brush, or ceramic porous substance; or when a partition is provided to divide the space where the humidified air and discharged water flow.

In the above structure, when humidified-air feeding motor 3030 is operated, sirocco fan 3029 feeds air to humidifying unit passageway 3037. When pressurized water or hot water is emitted from preliminary spraying nozzle 3038, sprayed water droplets and droplets generated by colliding with collision plate 3039 humidify the air supplied and heat exchange takes place. Large droplets and fine droplets are then separated as they pass through eliminator 3040. Only fine water droplets (water droplets with a diameter of 50 μm max.) are supplied to inner panel outlet passageway 3023 via humidified air outlet duct 3035. This air carries a fine airborne spray, and thus is very humid. On the other hand, water content whose temperature has decreased by heat exchange and large water droplets, which are not carried in the air, flows along the bottom of humidification duct 3032, and are discharged from drain outlet 3051 through drain pipe 3007. An atomization effect on collision can be improved by setting a longer distance between preliminary spraying nozzle 3038 and collision plate 3039, providing multiple preliminary spraying nozzles 3039, or increasing water volume to be sprayed using a flow rate control valve for increasing the flow rate. In other words, humidification takes place by spraying water droplets to the air and evaporating these droplets so as to increase the partial pressure of steam to create high-humidity conditions. If the air volume is small or air temperature is low, the saturated partial pressure of steam is low. Accordingly, high humidity is achieved with a low water content, and 100% humidity is likely to be achieved. However, measures need to be taken to increase the supply of fine water droplets if the wind volume increases or air temperature rises. Highly humid air containing negative ions is generated by the Lenard's effect when water droplets are atomized.

Figure 5:
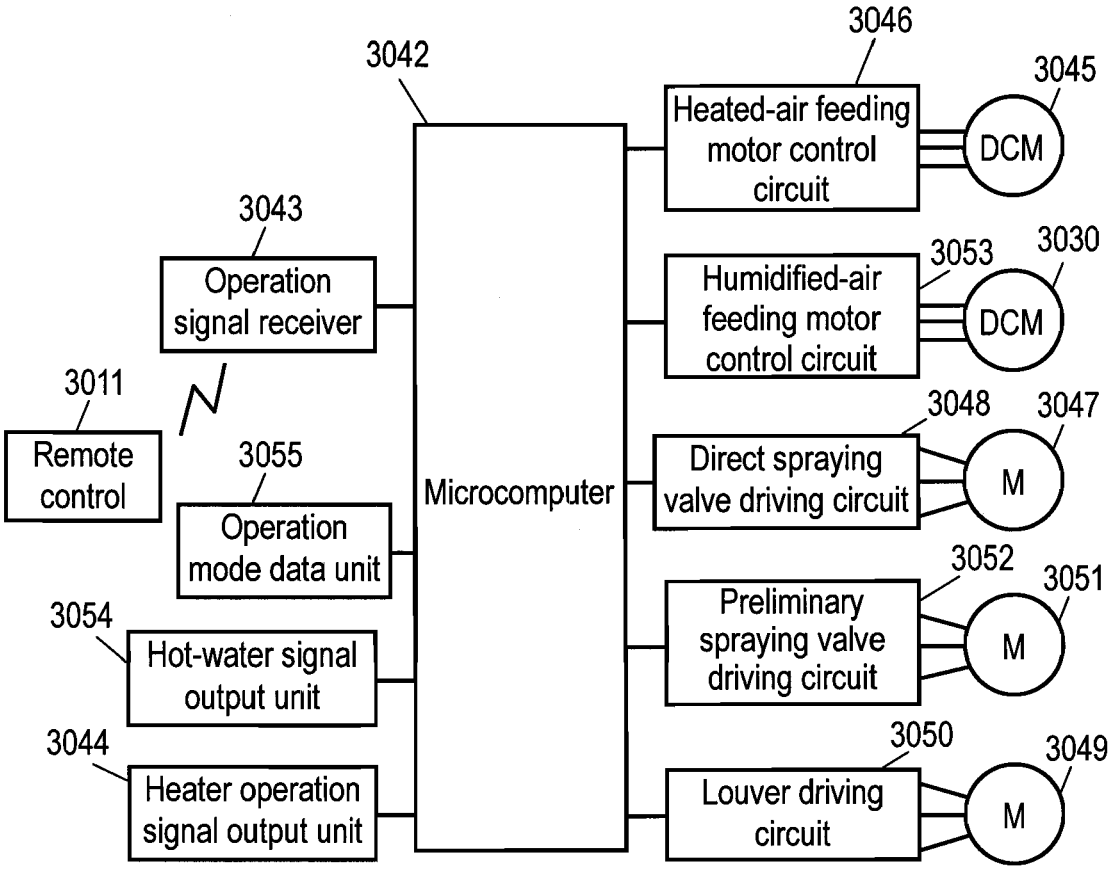
FIG. 5 is a block diagram of a control system for operation mode of the sauna equipment in accordance with the third exemplary embodiment of the present invention.

FIG. 5 is a block diagram of a control system for operation modes of the sauna equipment in the ninth exemplary embodiment of the present invention. In FIG. 5, components same as those in FIGS. 1 to 4 are given the same reference marks to omit duplicate description.

In FIG. 5, electrical unit 3027, which houses electrical control devices as a controller of the sauna equipment, includes microcomputer 3042 for controlling the sauna equipment as a related electrical control device. Operation signal receiver 3043 is connected to the input side of this microcomputer 3042 so as to receive a signal from remote control 1011.

Heater operation signal output unit 3044 for operating the heater is connected to the output side of microcomputer 3042. When the signal is output from here, the boiler, which is the heat source, is operated to run hot water.

Heated-air feeding motor control circuit 3046 is connected to the output side of microcomputer 3042 for operating heated air-feeding motor 3045, which drives reflux fan 3018 of the heated air feeder, and changing the speed of revolution of heated-air feeding motor 3045 which changes the feeding volume of heated air as a heated-air feeding regulator.

Direct spraying valve driving circuit 3048 is connected to the output side of microcomputer 3042 for opening and closing direct spraying valve 3047 which is provided between direct spraying nozzle 3022, i.e., direct sprayer, and water-supply pipe 3006 so as to open and close a water channel.

In addition, louver driving circuit 3050, which is connected to louver motor 3049 for driving louver 3025, is connected to the output side of microcomputer 3042 for opening and closing the louver or changing the wind direction by varying the opening angle. Louver driving circuit 3050 is connected to louver motor 3049 for driving louver 3025.

Preliminary spraying valve driving circuit 3052 is also connected to the output side of microcomputer 3042 for opening and closing preliminary spraying valve 3051, which is provided between preliminary spraying nozzle 3038, i.e., the humidifier, and water-supply pipe 3006 so as to open and close a water channel.

Humidified-air feeding motor control circuit 3053 is also connected to the output side of microcomputer 3042 for operating humidified-air feeding motor 3030, which drives sirocco fan 3029, i.e., the humidified air feeder, and changing the speed of revolution of humidified-air feeding motor 3030 which changes the feeding volume of humidified air as a humidified-air feeding regulator.

Hot-water signal output 3054 is also connected to the output side of microcomputer 3042 for heating water fed from the water-supplier. When a signal is output from here, the supplied water is heated, for example, by the boiler or the water heater (not illustrated).

In addition, operation mode data unit 3057 is connected to microcomputer 3042. This operation mode data unit 3055 stores data on which output to execute among heater operation signal output unit 3044, heated-air feeding motor control circuit 3046, direct spraying valve driving circuit 3048, louver driving circuit 3050, preliminary spraying valve driving circuit 3052, humidified-air feeding motor control circuit 3053, and hot-water signal output unit 3054; in response to a signal received from remote control 3011.

In addition, a sensor (not illustrated) is connected to microcomputer 3042 for detecting the temperature or humidity of sauna cabinet 3001 based on inlet temperature or humidity. Information on wind volume, set temperature, and humidity is input from the remote control, in addition to mode signals. Microcomputer 3042 also has a program for controlling the equipment based on these conditions.

TABLE 1

| | High-power mode | Mild mode | Wet mode | Cool-down mode |
|---|---|---|---|---|
| Heater operation signal output unit 3044 | ON | ON | ON | OFF |
| Heated-air feeding motor control circuit 3046 | ON | ON | ON | ON |
| Direct spraying valve driving circuit 3048 | ON | OFF | ON | ON |
| Louver driver circuit 3050 | ON | ON | ON | ON |

TABLE 1-continued

| | High-power mode | Mild mode | Wet mode | Cool-down mode |
|---|---|---|---|---|
| Preliminary spraying valve driving circuit 3052 | ON | ON | OFF | ON |
| Humidified-air feeding motor control circuit 3053 | ON | ON | OFF | ON |
| Hot-water signal output unit 3054 | ON | ON | ON | OFF |

Table 1 is a logic table illustrating an operation mode logic of the control system for the sauna equipment in this exemplary embodiment of the present invention. In Table 1, components same as those in FIGS. 1 to 5 are given the same reference marks to omit duplicate description.

One of the signals from remote control 3011 is for high-power mode. The output data stored in operation mode data unit 3055 for this operation mode turns on all, i.e., heater operation signal output unit 3044, heated air feeding motor control circuit 3046, direct spraying valve driving circuit 3048, louver driving circuit 3050, preliminary spraying valve driving circuit 3052, humidified-air feeding motor control circuit 3053, and hot-water signal output unit 3056. Other operation modes are mild mode, wet mode, and cool-down mode.

In the above structure, when the sauna equipment is operated in high-power mode, humidified-air feeding motor 3030 of the humidified air feeding means operates by turning on the humidified-air feeding motor control circuit. In addition, heating air-feeding motor 3045 of the heating air feeder operates by turning on heated-air feeding motor control circuit 3046. This propels the air in sauna cabinet 3001 into main unit 3003 through humidifying air inlet 3028 and main unit air inlet 3020. The air taken in from humidifying air inlet 3028 passes through humidifying unit passageway 3037, and is heated and humidified by hot water sprayed using preliminary spraying nozzle 3038 when preliminary spraying valve driving circuit 3052 and hot-water signal output unit 3056 are turned on. Humidified air is then fed through humidification duct 3032 to inner panel air outlet passageway 3023, provided before air outlet 3024.

On the other hand, the air taken into main unit 3003 through main unit air inlet 3020, provided on inner panel 3013, is heated by water-air heat exchanger 3015 using hot water supplied from the heat source when heater operation signal output unit 3044 turns on. Heated air is then fed through heated air passageway 3021 and main unit air outlet 3019 to inner panel air outlet passageway 3023, provided before air outlet 3024. The humidified air and heated air combine and are mixed, and combined heated and humidified air is blown from air outlet 3024 provided on outer panel 3014 into sauna cabinet 3001 via louver 3025 opened by turning on louver driving circuit 3050.

In addition, direct spraying valve 3047 opens by turning on direct spraying valve driving circuit 3048. Direct spraying nozzle 3022 emits hot water in the form of relatively large water droplets toward inner panel air outlet passageway 3023 by turning on hot-water signal output unit 3056. When louver driving circuit 3050 is turned on, its opening angle is adjustable by remote control 1011. Accordingly, relatively large visible droplets, in addition to a fine spray, are mixed with the heated and humidified air passing the surface of louver 3025 opened to a predetermined angle, and they can be supplied to sauna cabinet 3001 in the direction set by the user. Sauna cabinet 3001 thus offers a sauna space that allows the user to sweat within a shorter period. The air is full of steam, and also contains fine droplets. This operation mode achieves the highest humidity.

Next, when the sauna is operated in a mild mode, direct spraying valve driving circuit 3048 is turned off, unlike in high-power mode. In this mode, hot water is sprayed from preliminary spraying nozzle 3038 of the humidifier, and sirocco fan 3029 feeds the humidified air through humidifying unit passageway 3037. The air heated by water-air heat exchanger 3015 is supplied by reflux fan 3018. The humidified air and heated air combine in inner panel air outlet passageway 3023, and heated and humidified air containing only invisible fine droplets is supplied to sauna cabinet 3001. Accordingly, sauna cabinet 3001 offers a sauna space in which the user can stay relaxed for a long period while sweating. The air does not contain steam in this mode.

Next, when the sauna is operated in wet mode, emission of droplets from preliminary spraying nozzle 3038 stops. Direct spraying nozzle 3022 emits relatively large droplets toward inner panel air outlet passageway 3023, and these droplets join the air heated by water-air heat exchanger 3015, and is fed by reflux fan 3018. As a result, only relatively large visible droplets are supplied to sauna cabinet 3001. If the angle of louver 3025 is adjusted, the mist spraying range can be set to be directed towards the user. This offers a sauna space that allows sweating while wetting the body. In this mode, water is not supplied to and emitted from the humidifying unit. Accordingly, no water is discharged from drain outlet 3041. The air is full of steam in this mode.

Next, when cool-down operation takes place, unheated city water is emitted from preliminary spraying nozzle 3038, and thus the air taken in is cooled by vaporization heat. Unheated city water is further emitted from direct spraying nozzle 3022 to inner panel air outlet passageway 3023, and is mixed with unheated air so that air containing relatively large droplets is supplied to sauna cabinet 3001. Sauna cabinet 3001 thus offers a sauna space in which the user can wash off their sweat while cooling down the body by vaporization heat of the water drops clinging to the user's body. This creates a space effective for cooling down and relaxing by washing off sweat after taking a sauna.

In the high-power operation mode, the temperature and humidity of sauna cabinet 3001 are detected by inlet temperature or humidity sensors so as to control stopping of emission from direct spraying nozzle 3022 or preliminary spraying nozzle 3038, or control reduction or stopping of the volume of air fed to heated air passageway 3021 or humidifying unit passageway 3037 when the temperature or humidity reaches a predetermined level after passing a predetermined time from starting the operation. For adjusting temperature in this operation, more specifically, the speed of revolution of reflux fan 3018 is reduced by heated-air feeding motor control circuit 3046 so that the volume of air fed to heated air passageway 3021 can be reduced, in turn reducing the heating output. For adjusting humidity, the speed of revolution of sirocco fan 3029 is reduced by humidified-air feeding motor control circuit 3053 so that the volume of air fed to humidifying unit passageway 3037 can be reduced, in turn reducing the humidification output. Similar methods are also applicable in the mild mode and wet mode. Still more, the sauna equipment can be operated at uniform temperature and humidity by turning off the output of hot-water signal output unit 3056 or turning off heater operation signal output unit 3044, and feeding the least air volume to circulate in sauna cabinet 3001.

In the third exemplary embodiment of the present invention, a system for exchanging heat by circulating hot water is configured with boiler 3008, hot-water approaching pipe 3009, hot-water returning pipe 1010, water-air heat exchanger 3015, the boiler for heating city water, heater, and so on. A system for exchanging heat by circulating refrigerant such as R410A and $CO_2$ is also applicable, configuring the system with heat source equipment with a compressor, refrigerant pipe, and refrigerant heat exchanger. As a method of heating city water, it is also apparent that the same effect is achievable by providing a water-water heat exchanger in hot-water approaching pipe 3009 of boiler 3008 and heating the city water by passing it through this water-water heat exchanger.

Through these systems, fine water drops are blown together with heated air. Accordingly, the temperature and humidity of air blown from air outlet 3024 become uniform without variation. The sauna equipment thus offers sauna cabinet 3001 with uniform temperature and humidity.

The temperature and humidity can be easily controlled by adjusting the air volume of blown heated air by providing direct spraying nozzle 3022 downstream of the heated air feeder. Accordingly, a space with stable temperature and humidity can be produced. In addition, water drops with small diameter which have circulated in sauna cabinet 3001 reach humidifying air inlet 3028, main unit air inlet 3020, inner panel 3013, and finally outer panel 3014. Accordingly, dew condensation can be reduced, suppressing the propagation of molds.

Direct spraying nozzle 3022 is provided near the upstream of louver 3025, and the direction in which heated and humidified air is blown can be changed by adjusting the angle setting of louver 3025. Accordingly, no equipment other than louver 3025 is needed for changing the spraying angle. A space with uniform temperature and humidity can be achieved, while also improving the reliability. In addition, since direct spraying nozzle 3022 is provided inside louver 3025, diverse designs satisfying the user's preferences are feasible.

Still more, the flow rate of water drops emitted from direct spraying nozzle 3022 is accelerated due to the wind velocity of air fed from heated air passageway 3021. This also reduces the water drops to finer particles. Accordingly, the heated air and humidified air reach every corner of even a large bathroom of about 5-m2 floor area, offering a space with uniform temperature and humidity Still more, the temperature and humidity are controlled by controlling emissions from direct spraying nozzle 3022 and preliminary spraying nozzle 3038, and air feeding volume in heated air passageway 3021 and humidifying unit passageway 3037; and also by switching between the output from hot-water signal output unit 3056 and heater operation signal output unit 3044. The present invention thus offers a stable temperature and humidity space with quick startup that can satisfy a wide range of user preferences.

Still more, eliminator 3040 separates large droplets from fine droplets, and collects large droplets. This makes the humidified air contain only fine droplets. The heated air joins in inner panel air outlet passageway 3023, and good distribution of temperature and humidity in the air blown from air outlet 3024 is achieved. Accordingly, sauna cabinet 3001 without perceivable airborne water droplets is achievable. The present invention thus offers sauna cabinet 3001 that protects the user against the discomfort of falling water drops. The user can thus read in sauna cabinet 3001, broadening potential uses of sauna cabinet 3001. In addition, atomization of water by colliding with collision plate 3039 enables feeding of air containing a large number of negative ions to sauna cabinet 3001 due to the Lenard's effect.

The heating output is increased or decreased by increasing or decreasing the speed of revolution of reflux fan 3018 using heated air motor control circuit 3046 to increase or decrease the air feeding volume in heated air passageway 3021. The humidification output is increased or decreased by increasing or decreasing the speed of revolution of sirocco fan 3029 using humidified-air feeding motor control circuit 3053 so as to increase or decrease the air feeding volume in humidifying unit passageway 3037. The humidification output increases fairly proportionately to the wind volume. The humidification output is therefore easy to control. In combination with a temperature control, the temperature and humidity are thus easily controllable to provide any selected environment ranging from a low-temperature low-humidity space to a high-temperature high-humidity space.

Air outlet 3024 is provided on outer panel 3014 exposed to the inside of sauna cabinet 3001 by connecting an opening of air outlet 3024 to inner panel air outlet passageway 3023. All of the air is thus taken in from openings in outer panel 3014 and inner panel 3013. If main unit air inlet 3020 and humidifying air inlet 3028 are provided on inner panel 3013, as required, outlet heated air passageway 3021 and humidifying unit passage way 3037 can be configured. This reduces intake resistance, allowing efficient operation of reflux fan 3018 and sirocco fan 3029.

Fourth Exemplary Embodiment

Figure 6:
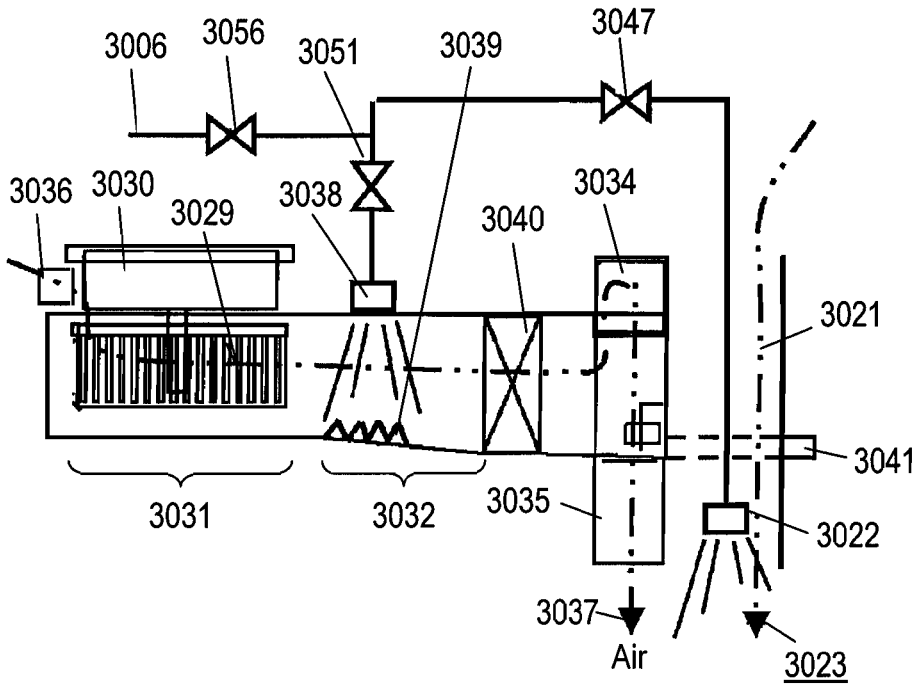
FIG. 6 is a block diagram of a state that a nozzle is connected in sauna equipment in accordance with a fourth exemplary embodiment of the present invention.

FIG. 6 is sauna equipment in the tenth exemplary embodiment of the present invention, and illustrates nozzle connection of direct spraying nozzle 3022 and preliminary spraying nozzle 3038. In FIG. 6, components same as those in FIGS. 1 to 5 are given the same reference marks to omit duplicate description.

In FIG. 6, main valve 3056 is connected to water-supply pipe 3006, and water-supply pipe 3006 is branched after main valve 3056. Preliminary spraying nozzle 3038 is connected to one branch via preliminary spraying valve 3051, and direct spraying nozzle 3022 is connected to the other branch via direct spraying valve 3047. Direct spraying nozzle 3022 is provided on heated air passageway 3021, and preliminary spraying nozzle 3038 is provided in humidifying unit passageway 3037. The pipe is not trap-shaped which obscures the flow or remaining water, i.e., a so-called torii piping in which the pipe lifts up and then goes down. When the operation stops, main valve 3056 is closed and preliminary spraying valve 3051 and direct spraying valve 3047 are opened.

In the above structure, the remaining water in the pipe is discharged from the spraying nozzle (not illustrated) at stopping the operation. Accordingly, the water does not remain in the pipe, and thus remaining water does not freeze inside the equipment, improving the reliability. In addition, a smell of remaining water and generation of molds are suppressed, and spraying of the remaining water is prevented. The sauna equipment thus offers better comfort.

Fifth Exemplary Embodiment

Figure 7:
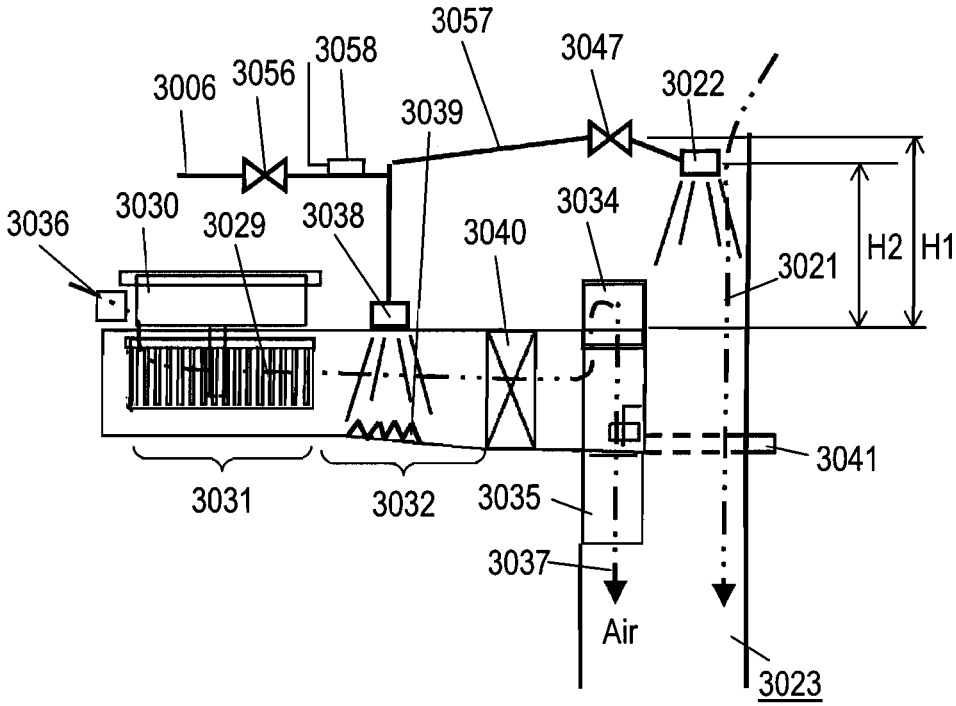
FIG. 7 is a block diagram of a state a nozzle is connected in sauna equipment in accordance with a fifth exemplary embodiment of the present invention.
Figure 8:
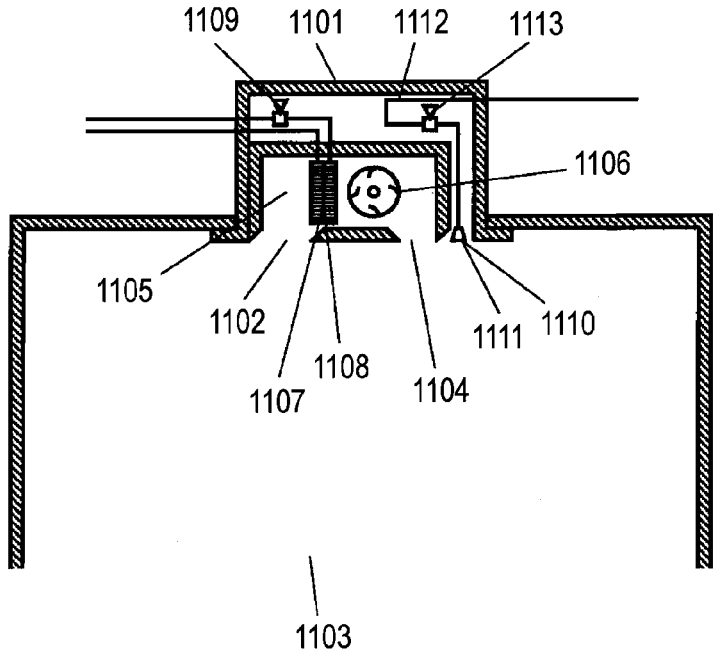
FIG. 8 PRIOR ART
FIG. 8 is a schematic diagram of conventional sauna equipment.
Figure 9:
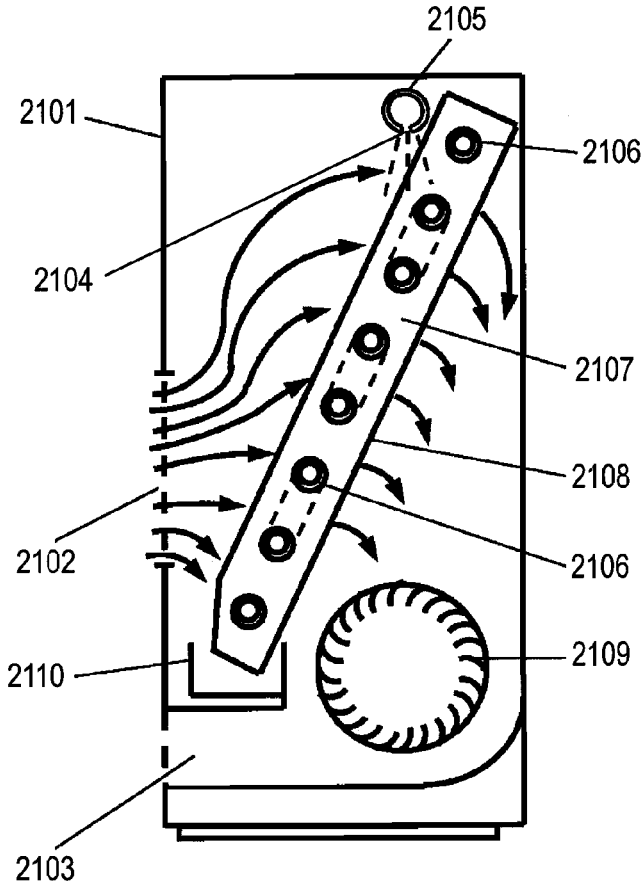
FIG. 9 PRIOR ART
FIG. 9 is an inner structure of the conventional sauna equipment.

FIG. 7 is sauna equipment in the fifth exemplary embodiment of the present invention, and illustrates nozzle connection of direct spraying nozzle 3022 and preliminary spraying nozzle 3038. In FIG. 7, components same as those in FIGS. 1 to 6 are given the same reference marks to omit duplicate description.

In FIG. 7, main valve 3056 is connected to water-supply pipe 3006, and then water-supply pipe 3006 is branched after main valve 3056. Preliminary spraying nozzle 3038 is connected to one branch and direct spraying nozzle 3022 is connected to the other branch via direct spraying valve 3047 as a valve. Direct spraying valve 3047 is provide at the top part of pipe 3057, which is H1 mm above preliminary spraying nozzle 3038. Direct spraying nozzle 3022 is provided at a position slightly lower than direct spraying valve 3047 and H2 mm above preliminary spraying nozzle 3038. Pipe 3057 continuously slopes down toward preliminary spraying nozzle 3038 and direct spraying nozzle 3022. The pipe is not a so-called torii piping which rises in the middle and then goes down. Water temperature sensor 3058 is provided in pipe 3057 as a water-supply temperature detector. For example, direct spraying valve 3047 is controlled such that it does not open unless water becomes 40° C. or higher for heating and humidification.

In the above structure, the remaining water is discharged from the spraying nozzle (not illustrated) just by closing main valve 3056 when the operation stops, regardless of whether direct spraying valve 3047 is opened or closed. Accordingly, the water does not remain inside the pipe, and the remaining water does not freeze inside the equipment, improving the reliability. In addition, a smell of the remaining water and generation of molds are suppressed, and spraying of the remaining water is also prevented. The sauna equipment thus offers better comfort. Furthermore, water temperature sensor 3058 acts to spray water only from the preliminary nozzle when cold water is supplied. Water for humidification is heated, and water which is not used for humidification is discharged outside from drain pipe 3041. Accordingly, cold water drops are not supplied to sauna cabinet 3001, further achieving better comfort.

In this exemplary embodiment, H2 is several millimeters greater than H1. When direct spraying valve 3047 is opened at stopping the operation, the remaining water in pipe 3057 is entirely dripped from preliminary spraying nozzle 3038 to humidifying unit 3026, and discharged from drain outlet t3041. Accordingly, water drops do not drip from air outlet 3024 at stopping the operation, offering comfortable sauna equipment.

Water remaining between direct spraying valve 3047 and direct spraying nozzle 3022 can be reduced by shortening this length. For example, water dripping is preventable by making water drops absorbed to an unwoven fabric provided on the back side of the louver after closing louver 3025.

When two humidifiers are used for humidification, as in the present invention, their humidity is generally controlled by operating or stopping one humidifier first and then operating or stopping the remaining humidifier step by step, compared to simultaneously operating or stopping two humidifiers. Accordingly, mist is emitted from the preliminary spraying nozzle for humidification by opening the main valve, and then mist is emitted from the direct spraying nozzle for humidification by opening the direct spraying valve. The operation can be effectively controlled using reduced number of valves.

INDUSTRIAL APPLICABILITY

The sauna equipment of the present invention enables humidification and heating without perceivable airborne water drops by the use of a fine spray. Accordingly, the present invention offers a high-temperature and high-humidity sauna space that allows the user to remain comfortable without any discomfort caused by airborne water droplets. Since there is no visible mist, the user can also enjoy viewing images and reading books. The sauna equipment of the present invention thus permits the use of a bathroom or other room as a sauna space.

Still more, the sauna equipment of the present invention enables easy control of temperature and humidity inside the sauna cabinet by the use of the humidifier mounted inside the cabinet. This is also applicable to ordinary air conditioners. The sauna equipment of the present invention also generates high-humidity air with a low outlet temperature, significantly increasing the sensible temperature. This is also applicable to ordinary heaters. The sauna equipment of the present invention is also applicable to equipment designed to conserve plants and accelerate their growth by the effects of a fine water spray. The sauna equipment of the present invention is also a humidifier involving water atomization. Accordingly, the present invention is applicable to a negative ion generator that employs the Lenard's effect. In the sauna equipment of the present invention, the blown air is high-humidity air containing fine water drops if hot water is not supplied. Accordingly, the present invention is also applicable to nebulizers.

Since heating during winter time in Hokkaido, a region of Japan with extremely cold winters, always requires humidification, the sauna equipment of the present invention is also applicable to air-conditioning equipment in which a heater and humidifier are integrally installed. The present invention is also applicable to equipment designed to conserve plants and accelerate their growth by the effects of a fine water spray. With respect to a humidifier involving water atomization, the present invention is also applicable to negative ion generators that employ the Lenard's effect.

What is claimed is:

1. Sauna equipment comprising:

a heat exchanger for heating air;

a fan for feeding air heated by the heat exchanger;

a direct sprayer for emitting water;

a water-supplier for supplying the water to the direct sprayer; and an air inlet and an air outlet for feeding air, wherein a heated air passageway is formed so as to extend from the air inlet, through the heat exchanger and the fan, and to the air outlet, wherein the direct sprayer is provided downstream of the fan, and is arranged so as to emit the water in the form of mist into the heated air passageway such that the mist is blown out with the heated air from the air outlet, and wherein the direct sprayer is a direct spraying nozzle.

2. The sauna equipment of claim 1, wherein the direct sprayer is provided upstream of the air outlet, and a louver for adjusting an air-feeding direction is provided on the air outlet.

3. The sauna equipment of claim 2, further comprising:

a humidifier for humidifying air; and a humidified air feeder for feeding air humidified by the humidifier, wherein an air blowing condition is changed by controlling operation of the heat exchanger, the fan, the direct sprayer, the louver, the humidifier, and the humidified air feeder, so as to change a proportion of sizes of water drops related to a mist sauna environment.

4. The sauna equipment of claim 1, further comprising:

a humidifier, wherein the humidifier includes a water-supplier for supplying water, a preliminary sprayer for emitting the water supplied from the water-supplier, a water atomizer for atomizing the water emitted from the preliminary sprayer by collision, and a vapor-liquid separator for separating large water drops and fine water drops among water drops supplied from the water-supplier, and for removing the large water drops.

5. The sauna equipment of claim 3, wherein the fan comprises a heated-air feeding regulator for changing a heated air volume, and the humidified air feeder comprises a humidified-air feeding regulator for changing a humidified air volume.

6. The sauna equipment of claim 1, further comprising:

a panel having an opening as an air outlet arranged so as to form an outlet passageway extending downwardly toward a ceiling face, wherein an inlet passageway is formed by arranging the air inlet on the panel or between the panel and ceiling.

7. The sauna equipment of claim 1, wherein the water-supplier comprises:

a main valve; and a preliminary sprayer for spraying water supplied from the water-supplier, wherein the direct sprayer and the preliminary sprayer include a direct spraying valve and a preliminary spraying valve as an on-off valve, respectively, and wherein remaining water is discharged by opening the on-off valve of the direct sprayer and the valve of the preliminary sprayer at a stopping operation.

8. The sauna equipment of claim 1, wherein the water-supplier comprises:

a main valve; and a preliminary sprayer for spraying water supplied from the water-supplier, wherein the water-supplier branches after the main valve, one of the direct sprayer and the preliminary sprayer is provided on one branch, and the other of the direct sprayer and preliminary sprayer is provided on another branch via a valve.

9. The sauna equipment of claim 8, wherein the valve is provided on a top part of a pipe.

10. The sauna equipment of claim 1, further comprising:

a preliminary sprayer for spraying water supplied from the water-supplier, wherein an opening of the direct sprayer is provided at a position higher than an opening of the preliminary sprayer.

11. The sauna equipment of claim 1, further comprising:

a preliminary sprayer for spraying water supplied from the water-supplier; and a water-supply temperature detector, wherein water is emitted only from the preliminary sprayer when a water temperature is low.

12. The sauna equipment of claim 1, further comprising:

a humidifier for humidifying air; and a humidified air feeder for feeding air humidified by the humidifier, wherein an air blowing condition is changed by controlling operation of the heat exchanger, the fan, the direct sprayer, the humidifier, and the humidified air feeder, so as to change a proportion of sizes of water drops related to a mist sauna environment.

13. The sauna equipment of claim 1, wherein the water-supplier is a water-supply pipe and the direct spraying nozzle is connected to the water-supply pipe.

14. The sauna equipment of claim 13, wherein the direct spraying nozzle is a flat spraying type nozzle.

15. The sauna equipment of claim 14, wherein the direct spraying nozzle has a spraying angle of 10°-140°.

16. The sauna equipment of claim 1, wherein the direct spraying nozzle is a flat spraying type nozzle.

17. The sauna equipment of claim 16, wherein the direct spraying nozzle has a spraying angle of 10°-140°.

* * * * *